United States Patent [19]

Vermillion et al.

[11] 4,391,018

[45] Jul. 5, 1983

[54] VACUUM CLEANER WITH WHEEL AND NOZZLE HEIGHT ADJUSTING MECHANISM

[75] Inventors: Don W. Vermillion; Francis S. Gromek, both of Anderson, S.C.; Scott S. Bair, III, Atlanta, Ga.

[73] Assignee: The Singer Company, Stamford, Conn.

[21] Appl. No.: 243,413

[22] Filed: Mar. 13, 1981

[51] Int. Cl.[3] ..... A47L 5/34

[52] U.S. Cl. ..... 15/339; 15/354

[58] Field of Search ..... 15/354, 355, 356, 357, 15/358, 360, 339

[56] References Cited

U.S. PATENT DOCUMENTS

| | | | |
|---|---|---|---|
| 3,848,292 | 11/1974 | Nordeen et al. | 15/354 X |
| 4,167,801 | 9/1979 | Erbor et al. | 15/354 |
| 4,199,839 | 4/1980 | Martinec | 15/354 |

*Primary Examiner*—Chris K. Moore

*Attorney, Agent, or Firm*—Edward P. Schmidt; Robert E. Smith; Edward L. Bell

[57] ABSTRACT

A suction cleaner having a chassis including a suction nozzle inlet at the bottom thereof and first and second sets of wheels supporting such chassis for movement on a floor surface is provided with a nozzle height adjusting mechanism comprising first axle means carried by said chassis for rotatably supporting said first set of wheels, second axle means including a central portion having a pintle shaft mounted therewith and with the chassis for enabling rocking movement of said axle means relative said chassis, an actuating portion on one side of said pintle shaft, and a pair of offset arms formed on an opposite side of said pintle shaft extending laterally outwardly thereof for journaling said second set of wheels, said offset arms being longitudinally spaced from said first axle means, an adjustment lever journaled on said chassis having one end portion angulated to engage said actuating portion so that rocking movement of said adjustment lever rocks said second axle means about said pintle shaft and thereby raises or lowers said second set of wheels relative said chassis and a second end portion extending through said chassis and being manually engageable by an operator to adjust the nozzle height as it is rocked back and forth thereby.

5 Claims, 4 Drawing Figures

VACUUM CLEANER WITH WHEEL AND NOZZLE HEIGHT ADJUSTING MECHANISM

DESCRIPTION

1. Field of the Invention

This invention relates to vacuum cleaners and more particularly to a vacuum or suction cleaner for carpets and other floor coverings having means for selectively raising and lowering the suction nozzle inlet depending on the pile height and density of the floor covering to be cleaned.

2. Background of the Invention

Vacuum cleaners of the floor covering cleaning or upright type generally include a chassis having a nozzle inlet at the bottom thereof through which air is sucked by an air moving motor-blower unit, a rotary brush mounted adjacent the nozzle inlet for contacting the floor surface to agitate and loosen the dirt so that it may be sucked free of the surface, and wheels mounted at the front and rear of the chassis for supporting the cleaner for rolling on the floor covering. These vacuum cleaners are called upon to clean many different kinds of modern floor coverings varying in pile height and density from the short outdoor, kitchen or patio type to the long deep shag type. In order to clean these various floor surfaces or coverings effectively, it is known to vary the nozzle inlet height to locate the nozzle inlet at a level above the surface to provide the proper suction and the flow path for the particular type of floor covering or surface being cleaned and to position the brush at the proper height.

In modern cleaners, because of the wide variety of pile heights in use, it has been generally preferred to vary the height of the rear wheels to adjust nozzle inlet height because the lever arm ratios available make large changes in nozzle height relatively easy to achieve.

In co-pending application Ser. No. 228,021 filed Jan. 23, 1981, and now U.S. Pat. No. 4,347,643, issued 9-7-82, by Scott Slaybaugh Bair III, entitled "Power Assist Drive Upright Vacuum Cleaner and Power Assist Drive System Therefor", assigned to the assignee of the present application, there is described, disclosed, illustrated and shown a power assist drive for a vacuum cleaner wherein a solid rear axle is connected through a transmission with the blower motor for selective power assist drive of the rear wheels. Such a power assist drive system makes elevating or lowering the rear wheels much less feasible and practical. Rather, with a power assist driven vacuum cleaner utilizing the drive assist of the aforesaid Bair application, in order to achieve nozzle height adjustability it becomes highly desirable to raise and lower the front, rather than the rear wheels relative the cleaner chassis. While it has been previously suggested to provide a nozzle height adjustment which directly raises or lowers the nozzle by raising or lowering the front wheels relative to the chassis the present mechanism has several advantages over such previously suggested mechanism, including ease of operation and visiblity of an indicator of the nozzle inlet height.

OBJECT OF THE INVENTION

Bearing in mind the foregoing, it is a primary object of the present invention to provide a novel and improved wheel and nozzle height adjusting mechanism for an upright vacuum cleaner.

Another primary object of the present invention, in addition to the foregoing object, is the provision of such a novel wheel and nozzle height adjusting mechanism which is easy to operate and which provides a clear, easily readable indication of the wheel and nozzle height setting.

Still another primary object of the present invention, in addition to each of the foregoing objects, is the provision of such a wheel and nozzle height adjusting mechanism effective to conveniently and easily adjust the height of the front wheels relative the chassis and, thereby, the nozzle height.

Yet still another primary object of the present invention, in addition to each of the foregoing objects, is the provision of novel and improved means for adjusting the nozzle and agitator/beater bar height of an upright suction carpet cleaner.

Another and still further primary object of the present invention, in addition to each of the foregoing objects, is to provide such mechanism and means which is inexpensive to manufacture, yet durable and effective in use.

Yet another and still further primary object of the present invention, in addition to each of the foregoing objects, is the provision of novel and improved height adjusting means and mechanism for an upright suction carpet cleaner which may be utilized for such a cleaner equipped with a power assist wheel drive.

Yet still another object of the present invention, in addition to each of the foregoing objects, is the provision of such a wheel and nozzle height adjusting mechanism which is easily operated by pressure of an operator's foot.

The invention resides in the combination, construction, arrangement and disposition of the various component parts and elements incorporated in improved carpet cleaners and in wheel and nozzle height adjusting mechanisms and means therefor in accordance with the principles of this invention. The present invention will be better understood and objects and important features other than those specifically enumerated above will become apparent when consideration is given to the following details and description which, when taken in conjunction with the annexed drawing, describes, discloses, illustrates and shows a preferred embodiment or modification of the present invention and what is presently considered and believed to be the best mode of practicing the principles thereof. Other embodiments or modifications may be suggested to those having the benefit of the teachings herein, and such other embodiments or modifications are intended to be reserved, especially as they fall within the scope and spirit of the subjoined claims.

SUMMARY OF THE INVENTION

A suction cleaner having a chassis including a suction nozzle inlet at the bottom thereof and first and second sets of wheels supporting such chassis for movement on a floor surface is provided with a nozzle height adjusting mechanism comprising first axle means carried by said chassis for rotatably supporting said first set of wheels, second axle means including a central portion having a pintle shaft mounted therewith and with the chassis for enabling rocking movement of said axle means around said pintle shaft relative said chassis, an actuating portion on one side of said pintle shaft, and a pair of offset arms formed on an opposite side of said pintle shaft extending laterally outwardly thereof for journaling said second set of wheels, said offset arms being longitudinally spaced from said first axle means, an adjustment lever journaled on said chassis having one end portion angulated to engage said actuating portion so that rocking movement of said adjustment lever rocks said second axle means about said pintle shaft and thereby raises or lowers said second set of wheels relative said chassis and a second end portion extending through said chassis and being manually engagable by an operator to adjust the nozzle height as it is rocked back and forth by such operator.

DESCRIPTION OF THE DRAWINGS

While the specification concludes with claims particularly pointing out and distinctly claiming the subject matter which is regarded as forming the present invention, it is believed the invention will be better understood from the following detailed description when taken in conjunction with the annexed drawing which discloses, illustrates, and shows a preferred embodiment or modification of the present invention and what is presently considered and believed to be the best mode of practicing the principles thereof and wherein:

DETAILED DESCRIPTION OF THE INVENTION

Figure 1:
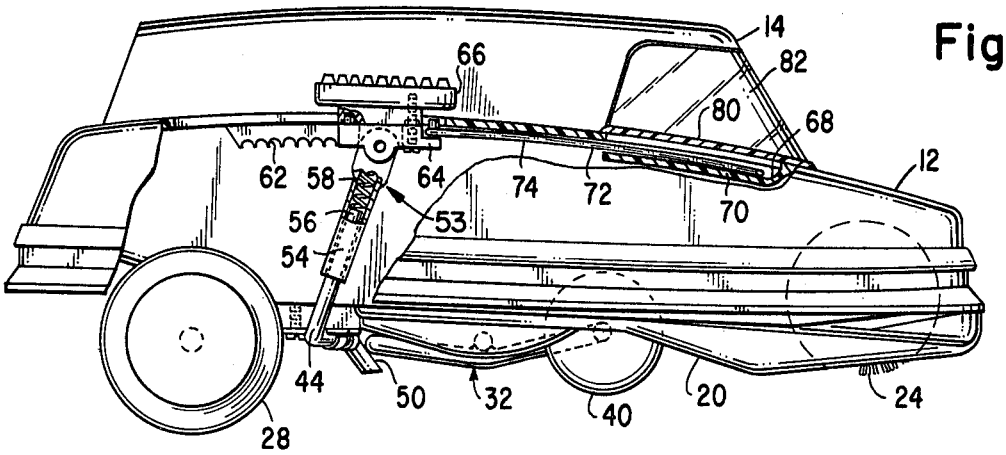
FIG. 1 is a side elevation view, partially in section, of an upright vacuum cleaner, with the handle removed for clarity of the drawing, including the wheel and nozzle height adjusting mechanism of the present invention.
Figure 2:
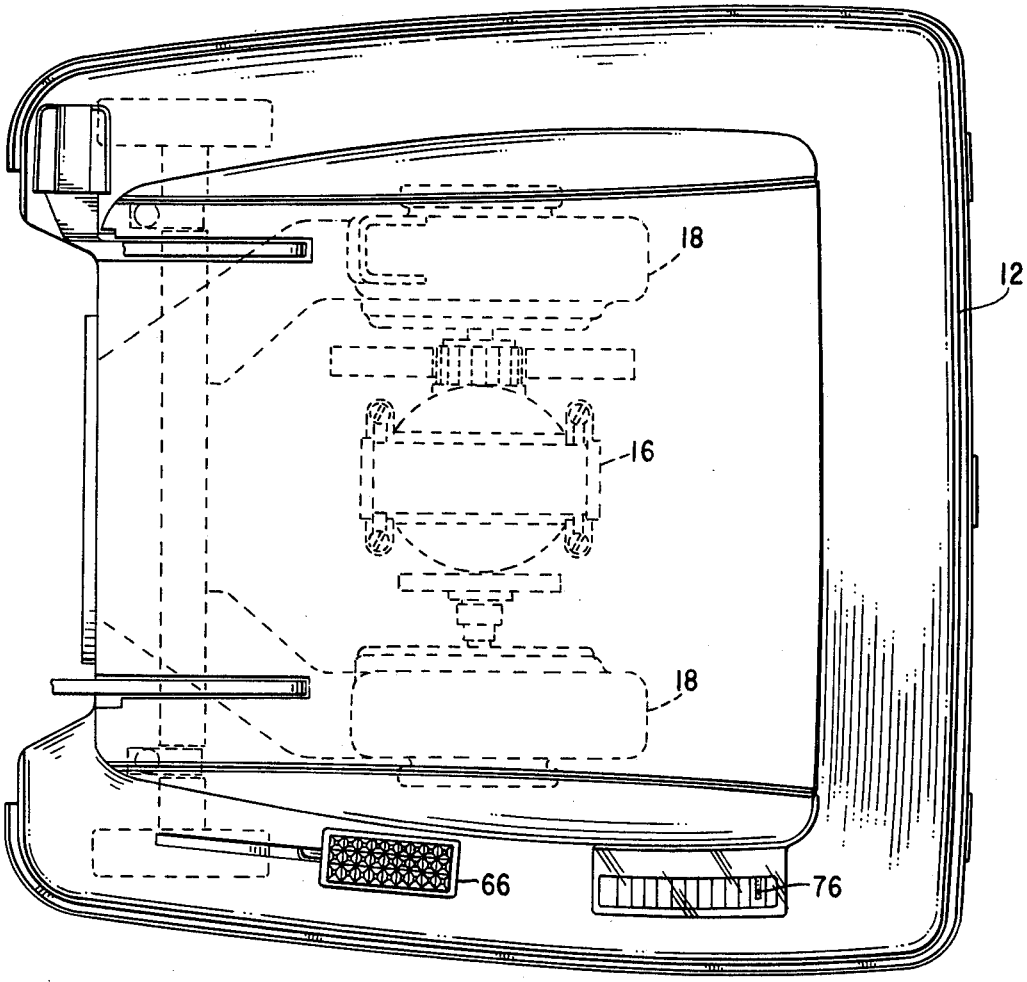
FIG. 2 is a top plan view of the cleaner of FIG. 1.
Figure 3:
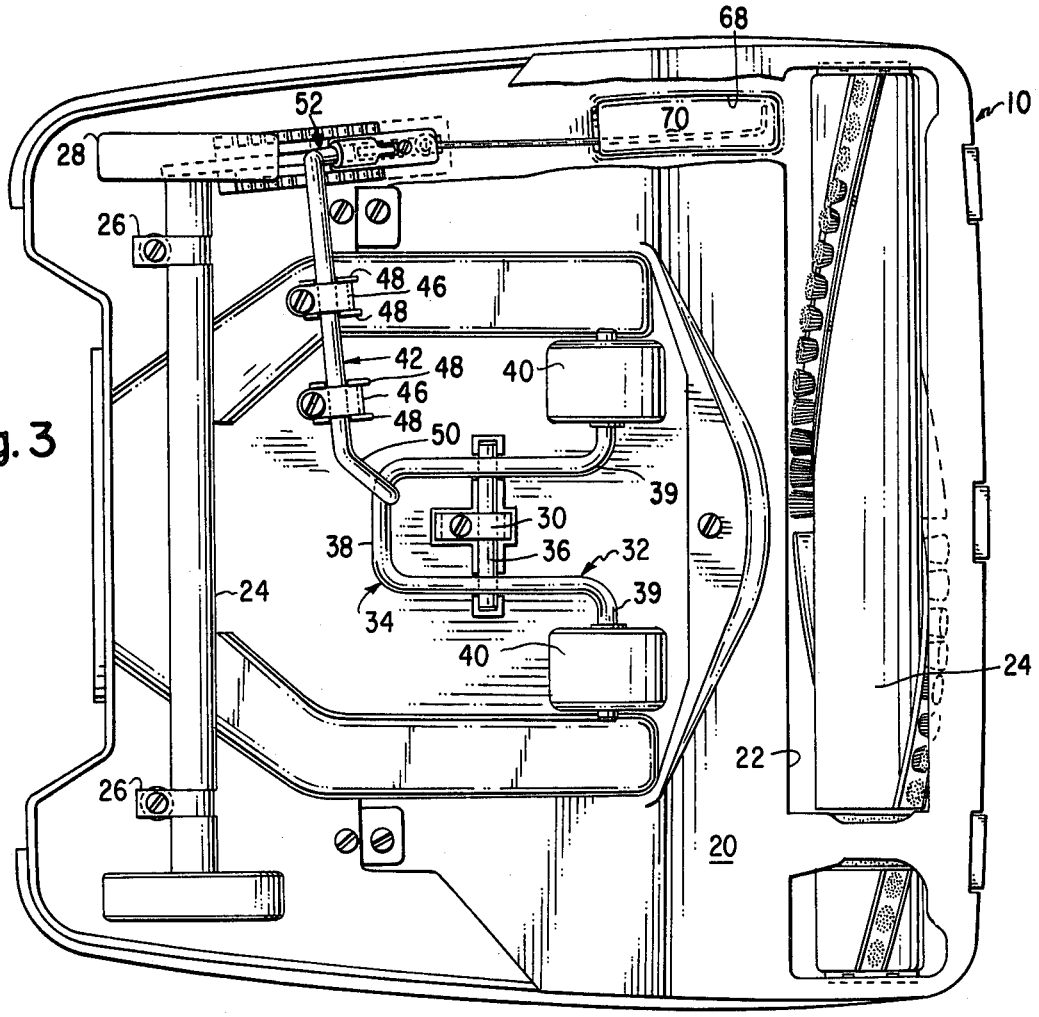
FIG. 3 is a bottom plan view thereof.

With reference now to the drawing, there is shown and illustrated an upright suction cleaner for floor coverings, and the like, designated generally by the reference character 10 and having the handle thereof removed for clarity of illustration. Also, as pointed out above, the present invention finds especial utility when applied to a suction cleaner having a power assist drive such as that described, disclosed, illustrated and shown in copending Application Ser. No. 228,021, filed Jan. 23, 1981, and now U.S. Pat. No. 4,347,643, 9/7/82 by Scott Slaybaugh Bair III, entitled "Power Assist Drive Upright Vacuum Cleaner And Power Assist Drive system Therefor", the entire disclosure of which is hereby incorporated herein by reference, as fully and completely as if reproduced hereat. In the present application, however, the suction cleaner 10 has been simplified for purposes of illustration by not including such power assist drive since such power assist drive does not form any part of the present invention.

The vacuum cleaner includes a chassis 12 on the top of which is secured a hood 14. Mounted in the bottom of the chassis is an electric motor indicated generally at 16 and a pair of fan impellers driven thereby within fan housings carried by the chassis 12 designated generally at 18 which communicates through a discharge duct between the chassis 12, an access plate 20 and the hood 14 with a dust bag assembly. Reference may be had to U.S. Pat. No. 3,163,439 which issued Dec. 29, 1964 to the same assignee as the present invention, and hereby incorporated by reference, for details of a suitable propelling handle, dust bag and motor-blower unit. Reference may also be had to the aforesaid Bair application and to Ransom Application Ser. No. 199,882, filed Oct. 23, 1980, and now U.S. Pat. No. 4,342,369, issued 8-3-82 incorporated herein by reference. A vacuum cleaner nozzle inlet 22 is formed in the access plate 20 at the forward portion of the bottom of the chassis 12 and communicates the dirt laden air with the fans. A rotary floor brush assembly 24 is mounted in the nozzle above the inlet 22 so as to contact the floor surface or covering when the cleaner nozzle is at its proper elevation for the floor to be cleaned. conventionally, a belt, not shown, drives the brush assembly 24 from a spindle on the motor-fan shaft.

Mounted at the rear of the chassis 12 is a first or rear wheel axle 24 supported by means, for example, of a pair of axle retaining members 26. A pair of wheels 28 may be rotatably mounted with the axle 24. Also mounted to the chassis 12, as by a front axle retaining member 30, is a second or front axle means designated generally by the reference character 32 including a central portion 34 having a pintle shaft 36 mounted therewith and with the chassis 12, as by the axle retaining means 30 for enabling rocking movement of the front axle means 32 relative the chassis 12. The central portion 34 also includes an actuating portion 38 on one side of the pintle shaft 36 and a pair of offset arms 39 formed on an opposite side of the pintle shaft 36 extending laterally outwardly thereof for journaling a second or front set of wheels 40 thereon. The offset arms 39 are longitudinally spaced apart from the rear axle 24 and are generally parallel thereto, being disposed between the rear axle 24 and the nozzle inlet 22. Accordingly, rocking movement of the axle means 32 about the pintle shaft 36 raises and lowers the set of wheels 40 relative the chassis 12 and, therefore, pivot the chassis 12 about the rear axle 24 to raise and lower the height of the nozzle inlet 22 relative the floor covering or other surface upon which the cleaner 10 sits.

The axle means 32 may, as shown, be fabricated of a steel rod bent to define the central portion 34 to be generally U-shaped, with the bridge of the U defining the actuating portion 38 and with the two legs of the U having their distal end portions bent outwardly generally in line with one another to define the offset arms 39. It will be seen, that as the actuating portion 38 is raised, the wheels 40 will be lowered, and the nozzle inlet 22 raised. When the actuating portion 38 is lowered, the axle means 32 will pivot about the pintle shaft 36, raising the set of wheels 40 relative the chassis 12 and thereby lowering the nozzle inlet 22.

Figure 4:
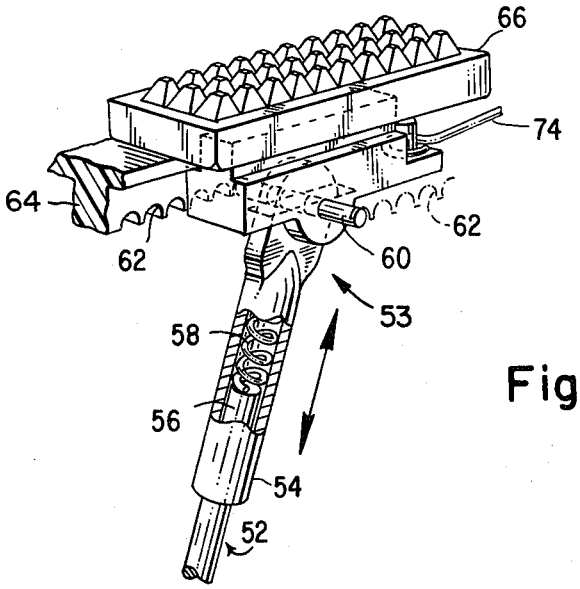
FIG. 4 is an enlarged perspective illustration of the upper end portion of the height adjusting mechanism, enlarged to show better the details thereof.

In order to raise and lower the actuating portion 38 of the axle means 32, an adjustment lever 42 may be journaled on the chassis 12, as by means of journal straps 46 mounted with the chassis 12 and bosses 48 also provided thereon. The adjustment lever 42 may have one end 50 angulated to engage the actuating portion 38 of the axle means 32 so that rocking movement of the adjustment lever 42 rocks the axle means 32 about the pintle shaft 36 and thereby raises or lowers the set of wheels 40 and the nozzle inlet 22 relative the chassis. The adjustment lever 42 further comprises a second end portion designated generally by the reference character 52 which cooperates with an operator engageable device 53 extending through the chassis 12 and being manually engagable by an operator to adjust the height of the nozzle inlet 22 as it is rocked back and forth thereby. With particular reference to FIG. 4, the operator engageable device 53 of the adjustment lever 42 may be made telescopic having a cap portion 54 disposed over the distal end 56 of the adjustment lever 42 biased upwardly and outwardly, as by means of a coil compression spring 58 therewithin. The cap portion 54 is provided with a laterally extending pin 60 which selectively engages one of a number of teeth 62 provided on a locking plate 64 mounted with the chassis 12 on both sides of the cap portion. The pin 60 defines transverse latching means selectively locked with the teeth 62 and the spring 58 defines biasing means tending to engage the latching means 60 with the teeth 62. The teeth 62, as shown, extend generally downwardly so that downward movement on the cap portion 54 releases the latching means from the teeth and enables rocking movement of the adjustment lever 42 and adjustment of the nozzle height while release thereof latches the latching means retaining the nozzle height where set. Also carried on the cap 54 there may be provided a foot pad 66 enabling the cap 54 to be easily depressed and moved by foot pressure of an operator enabling nozzle height adjustment to be made by foot pressure thereon.

The chassis 12 may be further provided with a generally rectangular well 68 having a generally flat bottom wall 70. The well 68 is generally upwardly open and is generally in longitudinal alignment with the cap or second end portion 54 of the adjustment lever 44. The well 68 is provided with an aperture 72 at the rear thereof through which an elongated pointer 74 extends, the rear end of which is carried by the locking plate 64 and the distal end 76 of the pointer 74 extends into the well 68 and is supported by the flat bottom wall 70 thereof. A scale 78 is provided so that the location of the distal end portion 76 indicates the nozzle height setting. A generally transparent cover 80 covers the well 68 and the distal end 76 of the pointer 74 and the transparent cover 80 may, as shown, constitute an extension of a lens 82 provided on the hood 14 of the cleaner 10.

While the invention has been described and illustrated in terms of a preferred embodiment or modification, such technical equivalence to the means described as well as to their combination, and other embodiments or modifications as may be suggested to those having the benefit of the teachings herein are intended to be reserved should they be carried out according to the spirit of the invention.

We claim:

1. In a suction cleaner having a chassis including a front suction nozzle inlet at the bottom thereof and rear and front sets of wheels supporting such chassis for movement on a floor surface, a nozzle height adjusting mechanism comprising rear axle means including a rear axle carried by said chassis for rotatably supporting said rear set of wheels, front axle means including a central portion having a pintle shaft mounted therewith and with the chassis for enabling rocking movement of said front axle means relative said chassis, said front axle means including an actuating portion extending rearwardly from said pintle shaft and a pair of offset arms forwardly of and formed on an opposite side of said pintle shaft extending laterally outwardly thereof for journaling said front set of wheels, said offset arms being longitudinally spaced from said rear axle means, means for adjusting the position of said front wheels relative said chassis, said adjusting means including an adjustment lever journaled on said chassis adjacent said rear axle with a journaled portion thereof substantially parallel thereto and having one end angulated to engage said actuating portion so that rocking movement of said adjustment lever rocks said front axle means about said pintle shaft and thereby raises or lowers said front set of wheels relative said chassis, an operator engageable means for cooperating with a second end of said adjustment lever and extending upwardly through said chassis to a position accessible by an operator from an operating position for said suction cleaner for engagement by the foot of said operator to adjust nozzle height as said operator engageble means is rocked in a front to back direction thereby.

2. In the suction cleaner of claim 1 said nozzle height adjusting mechanism further comprising a locking plate mounted on the chassis having a plurality of spaced apart teeth, said operator engageable means further including a telescopic portion provided with transverse latching means selectively locked with said teeth together with biasing means tending to engage said latching means with said teeth.

3. In the suction cleaner defined in claim 2, said teeth being formed generally downwardly and said biasing means tending to extend said telescopic portion so that downward pressure on said operator engageable means releases said latching means from said teeth and enables adjustment of the nozzle height while release thereof latches said latching means retaining the nozzle height where set.

4. In the suction cleaner of claim 3, said further including a foot pad operator engageable means enabling nozzle height adjustment to be made by foot pressure thereon.

5. In the suction cleaner of claim 4, an upwardly open well provided in said chassis having a generally flat bottom wall generally in longitudinal alignment with said foot pad, an elongated pointer carried by said foot pad having a distal end extending into said well and being supported by said flat bottom wall to indicate the nozzle height setting, and a generally transparent cover over said well and pointer distal end.

* * * * *